US006765432B2

(12) United States Patent
Mitsui

(10) Patent No.: US 6,765,432 B2
(45) Date of Patent: Jul. 20, 2004

(54) SEMICONDUCTOR DEVICE WITH A LOW-POWER OPERATION MODE

(75) Inventor: Katsuyoshi Mitsui, Hyogo (JP)

(73) Assignee: Renesas Technology Corp., Tokyo (JP)

( * ) Notice: Subject to any disclaimer, the term of this patent is extended or adjusted under 35 U.S.C. 154(b) by 0 days.

(21) Appl. No.: 10/335,941

(22) Filed: Jan. 3, 2003

(65) Prior Publication Data

US 2004/0000946 A1 Jan. 1, 2004

(30) Foreign Application Priority Data

Jun. 27, 2002 (JP) ..... 2002-187579

(51) Int. Cl.[7] ..... G05F 1/10; G05F 3/02
(52) U.S. Cl. ..... 327/544; 327/112
(58) Field of Search ..... 327/544, 112; 365/227

(56) References Cited

U.S. PATENT DOCUMENTS 6,016,070 A * 1/2000 Uehara ..... 327/176
6,021,082 A * 2/2000 Shirai ..... 365/226
6,201,418 B1 * 3/2001 Allmon ..... 327/52
6,232,800 B1 * 5/2001 Hirairi ..... 327/55

FOREIGN PATENT DOCUMENTS

JP 56-136029 10/1981
JP 06-196988 7/1994

* cited by examiner

*Primary Examiner*—Terry D. Cunningham
(74) *Attorney, Agent, or Firm*—McDermott Will & Emery LLC

(57) ABSTRACT

In a semiconductor device, a time-counting circuit counting a prescribed time in transition to a low-power operation mode includes a CR-type time constant circuit and a complementary NOR gate. The time-counting circuit causes electric charges to be released from a capacitive element through a resistance element when a prescribed signal attains L level. As release of the electric charges continues, the NOR gate operates, a power control signal is output at L level, and the semiconductor device makes a transition to the low-power operation mode. Thus, since the time-counting circuit does not include a multi-stage delay circuit and a latch circuit for time-count, power consumption is low, and circuit area is small. Consequently, the semiconductor device capable of transition to the low-power operation mode can simultaneously implement lower power consumption and smaller circuit area.

7 Claims, 10 Drawing Sheets

28C

SEMICONDUCTOR DEVICE WITH A LOW-POWER OPERATION MODE

BACKGROUND OF THE INVENTION

1. Field of the Invention

The present invention relates to a semiconductor device, and more particularly, to a semiconductor device capable of transition to a low-power operation mode in which the semiconductor device operates on a power lower than a power in a normal operation.

2. Description of the Background Art

As electronic equipment is made smaller and power consumed therein is lowered, a demand for lower power consumption in a semiconductor device mounted to the electronic equipment has increased. Lower power consumption in the semiconductor device can be implemented in the following manner, in accordance with specifications of the electronic equipment to which the semiconductor device is mounted. That is, an operation of a prescribed circuit in the semiconductor device is stopped to reduce current consumption in the circuit to zero, and a frequency rate of a signal input to the prescribed circuit in the semiconductor device is lowered to reduce charging/discharging current in the circuit.

In other words, when the semiconductor device is in the low-power operation mode in which the semiconductor device operates on a power lower than a power in the normal operation, computation or data input/output is not performed in general. Therefore, if the operation is stopped or the frequency rate of the input signal is lowered, for example, in a counting circuit, an arithmetic circuit or the like, power consumed in these circuits is reduced, and a semiconductor device with lower power consumption is implemented.

There are, however, some circuits of which operation cannot be stopped, so long as the semiconductor device is energized. FIGS. 7 and 8 described below show an example of such circuits.

FIG. 7 is a circuit diagram showing a configuration of an input circuit receiving a low-power operation mode instruction input from the outside.

Referring to FIG. 7, an input circuit 260 includes P-channel MOS transistors P101 to P104, N-channel MOS transistors N101, N102, inverters 101, 102, and nodes ND101 to ND103.

P-channel MOS transistor P101 is connected to an internal power supply node int.Vdd and node ND101, and has the gate connected to a ground node GND. P-channel MOS transistor P102 is connected to internal power supply node int.Vdd and node ND101, and receives an output signal of inverter 101 at the gate. P-channel MOS transistor P103 is connected to nodes ND101, ND102, and has the gate connected to node ND102. P-channel MOS transistor P104 is connected to nodes ND101, ND 103, and has the gate connected to node ND102. N-channel MOS transistor N101 is connected to node ND102 and ground node GND, and receives a reference voltage VREF at the gate. N-channel MOS transistor N102 is connected to node ND103 and ground node GND, and receives an input voltage SIG at the gate.

Inverter 101 outputs a signal obtained by inverting a logic level of a power control signal PWRCNTL, which will be described later. Inverter 102 has an input node connected to node ND103, and outputs as an internal signal intSIG, a signal obtained by inverting the logic level of an input signal.

P-channel MOS transistors P101 to P104 and N-channel MOS transistors N101, N102 constitute a current mirror differential amplifier. Input voltage SIG is applied from the outside, depending on whether or not the semiconductor device is subjected to transition to the low-power operation mode. Reference voltage VREF is a threshold voltage of input voltage SIG.

In other words, when input voltage SIG is higher than reference voltage VREF, node ND103 attains a voltage at which a logic level of a signal is comparable to L level (logic low), and the logic level of internal signal intSIG attains H level (logic high).

Meanwhile, when input voltage SIG is lower than reference voltage VREF, node ND103 attains a voltage at which the logic level of a signal is comparable to H level, and the logic level of internal signal intSIG attains L level.

The logic level of internal signal intSIG is thus switched, in accordance with variation of the voltage level of input voltage SIG, and switching between the low-power operation mode and the normal operation mode is performed.

A power control signal PWRCNTL is output from a time-counting circuit which will be described later, and attains logic L level in the low-power operation mode. When power control signal PWRCNTL is at L level, P-channel MOS transistor P102 turns off. Therefore, a direct current in the current mirror differential amplifier is reduced, and power consumed in input circuit 260 is lowered.

In input circuit 260, however, in the low-power operation mode, power consumed therein can be reduced while the operation thereof cannot be stopped. This is because, when the operation of input circuit 260 is stopped in the low-power operation mode, the semiconductor device can no longer receive input voltage SIG, and cannot return from the low-power operation mode to the normal operation mode.

Next, FIG. 8 is a circuit diagram showing a configuration of an internal power generating circuit supplying power to an internal circuit in the semiconductor device. In particular, the internal power generating circuit shown in FIG. 8 internally supplies power to input circuit 260 shown in FIG. 7, which receives the low-power operation mode instruction from the outside.

Referring to FIG. 8, an internal power generating circuit 300 includes P-channel MOS transistors P111 to P113, N-channel MOS transistors N111 to N114, and nodes ND111 to ND114.

P-channel MOS transistor P111 is connected to an external power supply node Vdd and node ND112, and has the gate connected to node ND111. P-channel MOS transistor P112 is connected to external power supply node Vdd and node ND 111, and has the gate connected to node ND111. N-channel MOS transistor N111 is connected to nodes ND112, ND 113, and receives reference voltage Vref at the gate. N-channel MOS transistor N112 is connected to nodes ND111, ND113, and receives a voltage Vcomp at the gate.

In addition, N-channel MOS transistor N113 is connected to node ND113 and ground node GND, and has the gate connected to external power supply node Vdd. N-channel MOS transistor N114 is connected to node ND113 and ground node GND, and receives power control signal PWRCNTL at the gate. Further, P-channel MOS transistor P113 is connected to external power supply node Vdd and node ND114, and has the gate connected to node ND112. Internal power supply voltage int.Vdd, which is an output of internal power generating circuit 300, is output to node ND114.

P-channel MOS transistors P111, P112 and N-channel MOS transistors N111 to N114 constitute the current mirror differential amplifier. Voltage Vcomp is in proportion to internal power supply voltage int.Vdd. Reference voltage Vref corresponds to a target voltage of internal power supply voltage int.Vdd.

When voltage Vcomp in proportion to internal power supply voltage int.Vdd is higher than reference voltage Vref, the voltage level of node ND112 is raised. Therefore, P-channel MOS transistor P113 turns off, and internal power supply voltage int.Vdd is lowered. On the other hand, when voltage Vcomp is lower than reference voltage Vref, the voltage level of node ND112 is lowered. Therefore, P-channel MOS transistor P113 turns on, and internal power supply voltage int.Vdd is raised. Thus, internal power supply voltage int.Vdd is adjusted to a prescribed voltage based on reference voltage Vref.

In internal power generating circuit 300, when power control signal PWRCNTL is at L level in the low-power operation mode, N-channel MOS transistor N114 turns off. Therefore, the direct current in the current mirror differential amplifier is reduced, and power consumed in internal power generating circuit 300 is lowered.

Here, in internal power generating circuit 300 as well, in the low-power operation mode, though power consumed therein can be reduced, the operation thereof cannot be stopped. The reason for this is as follows. If the operation of internal power generating circuit 300 is stopped in the low-power operation mode, a power supply in input circuit 260 shown in FIG. 7 will be unavailable. The semiconductor device can no longer receive input voltage SIG, and cannot return from the low-power operation mode to the normal operation mode.

As described above, in input circuit 260 shown in FIG. 7 and internal power generating circuit 300 shown in FIG. 8, the operation of the circuit cannot be stopped in the low-power operation mode. Meanwhile, the direct current in the current mirror differential amplifier can be reduced using power control signal PWRCNTL, to lower power consumption.

When the direct current in the differential amplifier is reduced, however, in principle, a response speed of the differential amplifier is decreased because the charging/discharging current therein is restricted by the direct current. Since transition from the normal operation mode to the low-power operation mode is performed under a condition where the direct current in the differential amplifier has not been reduced, the differential amplifier operates with a normal response speed. On the other hand, the transition from the low-power operation mode to the normal operation mode is performed under a condition where the direct current in the differential amplifier has been reduced. Therefore, the response speed of the differential amplifier is slow. Thus, the differential amplifier will not be able to respond, if an input thereto is provided at a high frequency.

When a state transition between the normal operation mode and the low-power operation mode is repeated at the high frequency in such a circuit, the operation of the circuit may be unstable, and the circuit may stop to function.

Conventionally, upon receiving a low-power operation mode instruction from the outside, an actual transition to the low-power operation mode has been performed after a certain period. In this manner, upon receiving the instruction to return to the normal operation mode immediately after receiving the low-power operation mode instruction, the transition to the low-power operation mode is not performed. Instead, it is performed only after the low-power operation mode instruction has continued for a certain period. Thus, an unstable operation of the circuit can be avoided.

FIG. 9 is a circuit diagram showing a configuration of a time-counting circuit having the above-described function.

Referring to FIG. 9, a time-counting circuit 280 includes a latch circuit 291, a delay circuit 292 with reset function, and inverters 121 to 123. Latch circuit 291 includes NAND gates 131 to 133. Delay circuit 292 with reset function includes inverters 124 to 129, and NAND gates 134 to 136.

Inverter 121 outputs a signal obtained by inverting the logic level of signal ENABLE. NAND gate 131 calculates a logical multiplication of output signals of inverters 121 and 129, and outputs a signal obtained by inverting the multiplication result. NAND gate 132 calculates a logical multiplication of output signals of NAND gates 131 and 133, and outputs a signal obtained by inverting the multiplication result. NAND gate 133 calculates a logical multiplication of output signals of inverter 121 and NAND gate 132, and outputs a signal obtained by inverting the multiplication result. Inverter 122 outputs a signal obtained by inverting the logic level of the output signal of NAND gate 133. Inverter 123 outputs a signal obtained by inverting the logic level of the output signal of inverter 122.

Inverter 124 outputs a signal obtained by inverting the logic level of the output signal of inverter 121. Inverter 125 outputs a signal obtained by inverting the logic level of the output signal of inverter 124. Inverter 128 outputs a signal obtained by inverting the logic level of the output signal of inverter 124. NAND gate 134 calculates a logical multiplication of output signals of inverters 125 and 128, and outputs a signal obtained by inverting the multiplication result. Inverter 126 outputs a signal obtained by inverting the logic level of an output signal of NAND gate 134. NAND gate 135 calculates a logical multiplication of output signals of inverters 126 and 128, and outputs a signal obtained by inverting the multiplication result. Inverter 127 outputs a signal obtained by inverting the logic level of the output signal of NAND gate 135. NAND gate 136 calculates a logical multiplication of output signals of inverters 127 and 128, and outputs a signal obtained by inverting the multiplication result. Inverter 129 outputs a signal obtained by inverting the logic level of the output signal of NAND gate 136.

Signal ENABLE is based on the low-power operation mode instruction input from the outside, and corresponds to output signal intSIG of input circuit 260 described above. Signal ENABLE attains logic L level when the semiconductor device is receiving the low-power operation mode instruction from the outside, while it attains logic H level when the semiconductor device is not receiving the same from the outside, that is, in the normal operation mode.

In the following, an operation of time-counting circuit 280 will be described.

FIG. 10 is an operational waveform diagram illustrating an operation of time-counting circuit 280.

Referring to FIG. 10, the vertical axis represents the logic level of each signal, and the horizontal axis represents time. Time period before time T1 represents the normal operation mode, in which signal ENABLE and power control signal PWRCNTL are both at H level. Latch circuit 291 is in a hold state, while delay circuit 292 is in a reset state.

At time T1, when signal ENABLE changes from H level to L level, latch circuit 291 exits the hold state, delay circuit 292 exits the reset state, and time-count at a delay stage starts. At time T2, however, when signal ENABLE returns to H level before the output signal of inverter 129, which is an output stage of delay circuit 292, is inverted, latch circuit 291 and delay circuit 292 are reset. Therefore, the output signal of NAND gate 133, which is an output stage of latch circuit 291, is not inverted, and power control signal PWRCNTL maintains H level. Thus, the direct current in input circuit 260 and internal power generating circuit 300 described above is not reduced, and the semiconductor device does not make a transition to the low-power operation mode.

Next, at time T3, when signal ENABLE changes again from H level to L level, latch circuit 291 exits the hold state, delay circuit 292 exits the reset state, and time-count at the delay stage starts. At time T4, when the output signal of inverter 129 is inverted while signal ENABLE maintains L level, latch circuit 291 is set, the output signal of NAND gate 133 is inverted, and power control signal PWRCNTL changes from H level to L level. In this way, the direct current in input circuit 260 and internal power generating circuit 300 described above is reduced, and the semiconductor device makes a transition to the low-power operation mode.

Thereafter, at time T5, when signal ENABLE changes from L level to H level, latch circuit 291 and delay circuit 292 are immediately reset, and power control signal PWRCNTL immediately changes from L level to H level. Therefore, the direct current in input circuit 260 and internal power generating circuit 300 described above returns from a reduced state to a normal operation state, and the semiconductor device returns from the low-power operation mode to the normal operation mode.

As described above, time-counting circuit 280 is necessary to implement a semiconductor device consuming lower power. Time-count circuit 280 includes latch circuit 291 and delay circuit 292 having multi-stage logic gates, and in addition, capacity of an inverter and an NAND gate in delay circuit 292 generally needs to be large. Accordingly, the charging/discharging current of time-counting circuit 280 itself will be large, and overall power consumption in the semiconductor device cannot sufficiently be lowered.

Moreover, the inverter and the NAND gate in delay circuit 292 of time-counting circuit 280 have large circuit area because of their large capacity. Thus, conventional time-counting circuit 280 has placed a constraint on reducing the size of the semiconductor device.

SUMMARY OF THE INVENTION

The present invention was made to solve the above-described problems. An object of the present invention is to provide a semiconductor device capable of transition to a low-power operation mode, and simultaneously implementing lower power consumption and smaller circuit area.

According to the present invention, a semiconductor device can make a transition to a low-power operation mode in which the semiconductor device operates on a power lower than a power in normal operation. The semiconductor device includes a time-counting circuit activating a control signal for transition to the low-power operation mode when a prescribed signal input to the semiconductor device is activated for a prescribed time period, and an internal circuit reducing power consumption in response to the control signal. The time-counting circuit includes a CR-type time constant circuit including a capacitive element and a resistance element, in which electric charges are charged and discharged to/from the capacitive element in accordance with a time constant determined by a capacitance value of the capacitive element and a resistance value of the resistance element; and a signal output circuit activating the control signal based on a voltage level determined by a charge state of the capacitive element. The prescribed time period is determined by the time constant of the CR-type time constant circuit.

In the semiconductor device according to the present invention, the time-counting circuit includes the CR-type time constant circuit and the signal output circuit. The CR-type time constant circuit counts a prescribed time in a transition to the low-power operation mode.

Therefore, according to the present invention, a time-counting circuit with low power consumption and small circuit area can be implemented, and power consumption in the semiconductor device can be reduced, which will contribute to reduce the size of the semiconductor device.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
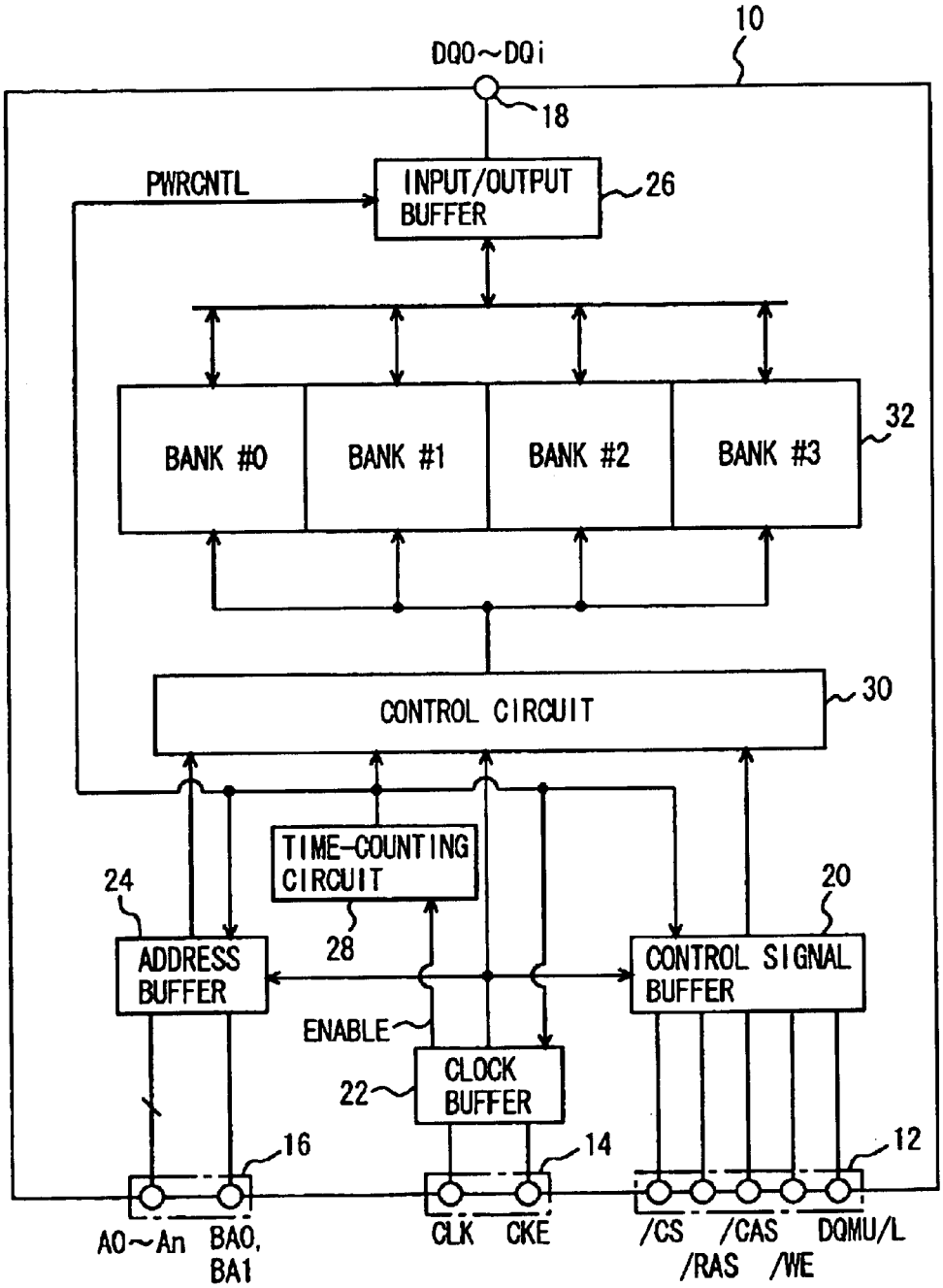
FIG. 1 is a schematic block diagram showing an overall configuration of a semiconductor device according to the present invention.

In the following, embodiments of the present invention will be described in detail with reference to the figures. It is noted that the same reference characters refer to the same or corresponding components in the figures, and description thereof will not repeated (First Embodiment)

FIG. 1 is a schematic block diagram showing an overall configuration of a semiconductor device according to the present invention.

Referring to FIG. 1, a semiconductor device 10 includes a control signal terminal 12, a clock signal terminal 14, an address signal terminal 16 and a data input/output terminal 18. Semiconductor device 10 also includes a control signal buffer 20, a clock buffer 22, an address buffer 24 and an input/output buffer 26. Semiconductor device 10 further includes a time-counting circuit 28, a control circuit 30 and a memory cell array 32.

Control signal terminal 12 receives command control signals including a chip select signal /CS, a row address strobe signal /RAS, a column address strobe signal /CAS, a write enable signal /WE and an input/output mask signal DQMU/L. Clock signal terminal 14 receives an external clock CLK and a clock enable signal CKE. Address signal terminal 16 receives address signals A0 to An (n is a natural number) and bank address signals BA0, BA1.

Clock buffer 22 receives external clock CLK and clock enable signal CKE by a current mirror differential amplifier. Clock buffer 22 then generates an internal clock based on external clock CLK, and outputs the same to control signal buffer 20, address buffer 24 and control circuit 30. Clock buffer 22 latches clock enable signal CKE, and outputs the same as a signal ENABLE to time-counting circuit 28. In addition, clock buffer 22 receives a power control signal PWRCNTL output from time-counting circuit 28, and when the logic level thereof is L level, clock buffer 22 reduces a direct current in the current mirror differential amplifier receiving clock signal CLK and clock enable signal CKE. Thus, power consumption is reduced.

Control signal buffer 20, in synchronization with the internal clock received from clock buffer 22, takes in chip select signal /CS, row address strobe signal /RAS, column address strobe signal /CAS, write enable signal /WE and input/output mask signal DQMU/L by the current mirror differential amplifier. Control signal buffer 20 then latches each of the above-described signals, and outputs those signals to control circuit 30. In addition, control buffer 20 receives power control signal PWRCNTL output from time-counting circuit 28, and when the logic level thereof is L level, control buffer 20 reduces the direct current in the current mirror differential amplifier taking in each of the above-described signals. Thus, power consumption is reduced.

Address buffer 24, in synchronization with the internal clock received from clock buffer 22, takes in address signals A0 to An and bank address signals BA0, BA1 by the current mirror differential amplifier. Address buffer 24 then latches address signals A0 to An and bank address signals BA0, BA1 that have been taken in, generates an internal address signal, and outputs the signal to control circuit 30. In addition, address buffer 24 receives power control signal PWRCNTL output from time-counting circuit 28, and when the logic level thereof is L level, address buffer 24 reduces the direct current in the current mirror differential amplifier taking in address signals A0 to An and bank address signals BA0, BA1. Thus, power consumption is reduced.

Data input/output terminal 18 communicates data read and written in semiconductor device 10 with the outside. In data writing, data input/output terminal 18 receives data DQ0 to DQi (i is a natural number) input from the outside, and in data reading, it outputs the same to the outside.

Input/output buffer 26 takes in data DQ0 to DQi by the current mirror differential amplifier in data writing. Input/output buffer 26 then latches the taken-in data DQ0 to DQi, and outputs internal data IDQ. Internal data IDQ output from input/output buffer 26 is written in memory cell array 32 through an input/output control circuit and a sense amplifier (not shown). On the other hand, in data reading, input/output buffer 26 outputs internal data IDQ read from memory cell array 32 to data input/output terminal 18.

Input/output buffer 26 receives power control signal PWRCNTL output from time-counting circuit 28, and when the logic level thereof is L level, input/output buffer 26 reduces the direct current in the current mirror differential amplifier taking in data DQ0 to DQi input to data input/output terminal 18 from the outside. Thus, power consumption is reduced.

Control circuit 30, in synchronization with the internal clock received from clock buffer 22, takes in a command control signal from control signal buffer 20, and controls a row address decoder, a column address decoder, an input/output control circuit and the like (not shown) based on the command control signal. Read and write of data DQ0 to DQi from/to memory cell array 32 is thus performed.

Memory cell array 32 storing data consists of four banks, each of which is capable of independent operation. Data is read and written through the input/output control circuit and the sense amplifier (not shown) based on an instruction from control circuit 30.

Time-counting circuit 28 receives signal ENABLE from clock buffer 22, and counts a time period during which signal ENABLE is maintained at L level. When a time count exceeds a prescribed time determined by the internal circuit, time-counting circuit 28 outputs power control signal PWRCNTL of L level to control signal buffer 20, clock buffer 22, address buffer 24, control circuit 30 and input/output buffer 26.

In semiconductor device 10, the low-power operation mode is set when clock enable signal CKE continuously stays at L level for a prescribed time period. When clock signal terminal 14 receives clock enable signal CKE of L level, clock buffer 22 outputs signal ENABLE at L level to time-counting circuit 28. When signal ENABLE attains L level, time-counting circuit 28 starts time count with an internal CR-type time constant circuit which will be described below.

After a time count exceeds a prescribed time, time-counting circuit 28 determines that the low-power operation mode has been set, and outputs power control signal PWRCNTL at L level to control signal buffer 20, clock buffer 22, address buffer 24, control circuit 30 and input/output buffer 26. The direct current in the current mirror differential amplifier included in each of these circuits is thus reduced, and power consumption in semiconductor device 10 is reduced.

On the other hand, when clock enable signal CKE returns from L level to H level, clock buffer 22 outputs signal ENABLE at H level to time-counting circuit 28. When signal ENABLE attains H level, time-counting circuit 28 immediately causes power control signal PWRCNTL to return to H level. Accordingly, the direct current in the current mirror differential amplifier included in each of these circuits returns to a normal level, and the semiconductor device exits from the low-power operation mode.

Figure 2:
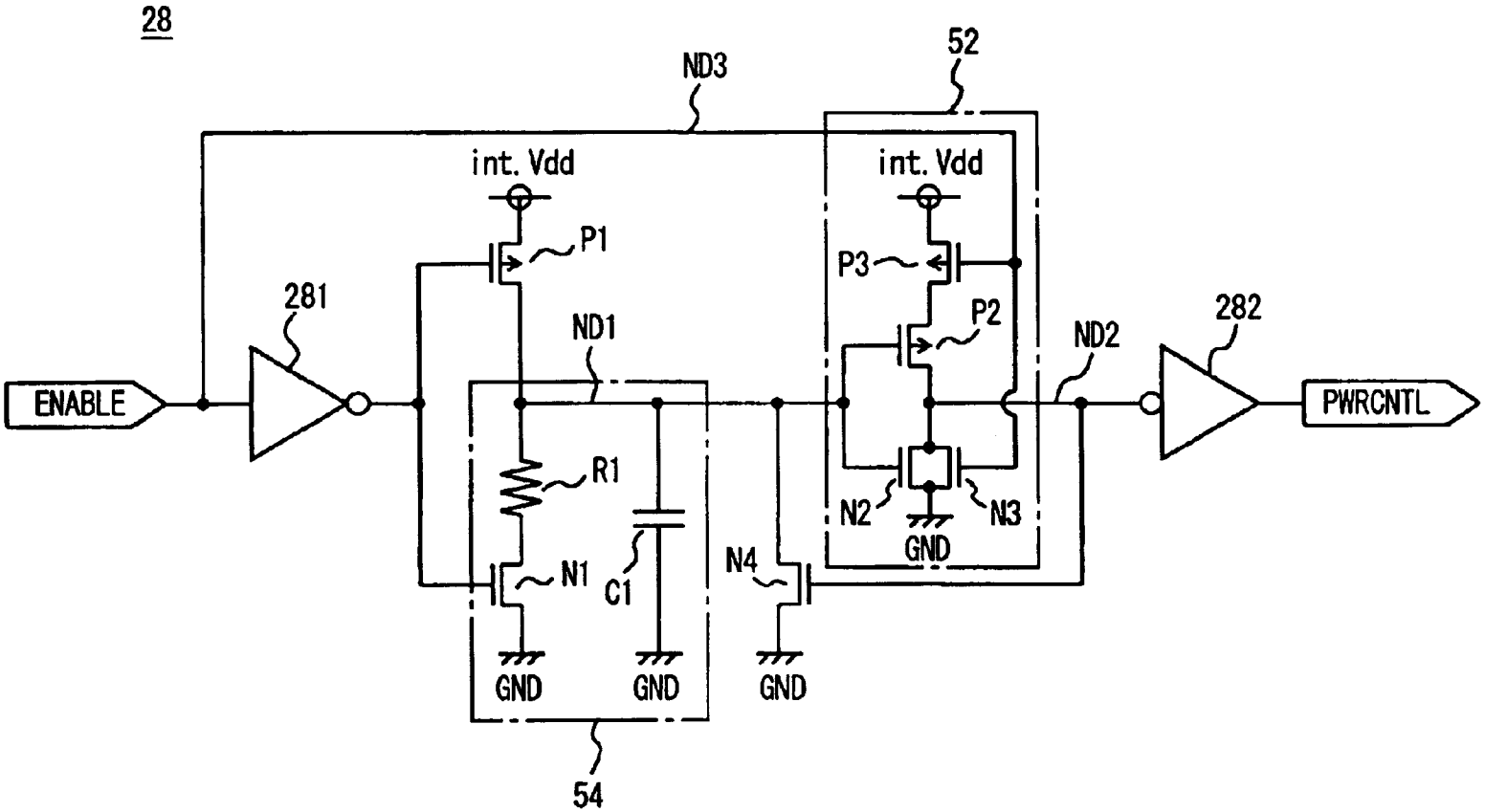
FIG. 2 is a circuit diagram showing a configuration of a time-counting circuit in the semiconductor device according to a first embodiment shown in FIG. 1.

FIG. 2 is a circuit diagram showing a configuration of time-counting circuit 28 shown in FIG. 1.

Referring to FIG. 2, time-counting circuit 28 includes a capacitive element C1, a resistance element R1, P-channel MOS transistors P1 to P3, N-channel MOS transistor N1 to N4, inverters 281, 282, and nodes ND1 to ND3. Capacitive element C1 and resistance element R1 constitute a CR-type time constant circuit 54. P-channel MOS transistors P2, P3 and N-channel MOS transistors N2, N3 constitute a complementary NOR gate 54.

Upon receiving signal ENABLE output from clock buffer 22, inverter 281 outputs a signal obtained by inverting the logic level of signal ENABLE. P-channel MOS transistor P1 is connected to internal power supply node int.Vdd and node ND1, and receives an output of inverter 281 at the gate. N-channel MOS transistor N1 is connected to resistance element R1 and ground node GND, and receives the output of inverter 281 at the gate.

Resistance element R1 is connected to node ND1 and N-channel MOS transistor N1. Capacitive element C1 is connected to node ND1 and ground node GND. Here, resistance element R1 may be connected between N-channel MOS transistor N1 and ground node GND.

P-channel MOS transistor P3 is connected to internal power supply node int.Vdd and P-channel MOS transistor P2, and receives signal ENABLE at the gate. N-channel MOS transistor N3 is connected to node ND2 and ground node GND, and receives signal ENABLE at the gate. P-channel MOS transistor P2 is connected to P-channel MOS transistor P3 and node ND2, and have the gate connected to node ND1. N-channel MOS transistor N2 is connected to node ND2 and ground node GND, and has the gate connected to node ND1.

N-channel MOS transistor N4 is connected to node ND1 and ground node GND, and has the gate connected to node ND2. Inverter 282 has an input node connected to node ND2, and outputs as power control signal PWRCNTL, a signal obtained by inverting the logic level of an output signal of NOR gate 52, supplied to node ND2.

P-channel MOS transistor P1 turns on when signal ENABLE attains H level, and charges electric charges to capacitive element C1. N-channel MOS transistor N1 turns on when signal ENABLE attains L level, and discharges electric charges from capacitive element C1 through resistance element R1.

Capacitive element C1 and resistance element R1 constitute CR-type time constant circuit 54 as described above. When N-channel MOS transistor N1 turns on, charges stored in capacitive element C1 are discharged in accordance with a time constant determined by capacitive element C1 and resistance element R1.

Meanwhile, P-channel MOS transistors P2, P3 and N-channel MOS transistors N2, N3 constitute complementary NOR gate 52 as described above. When signals of nodes ND3 and ND1, which are input nodes, both attain logic L level, NOR gate 52 outputs a signal of H level to node ND2, which is an output node, and accordingly, power control signal PWRCNTL attains L level.

N-channel MOS transistor N4 turns on when the logic level of a signal of node ND2 attains H level, and latches node ND2 to H level, along with P-channel MOS transistor P2 and N-channel MOS transistor N2 included in NOR gate 52.

In the following, an operation of time-counting circuit 28 will be described.

Figure 3:
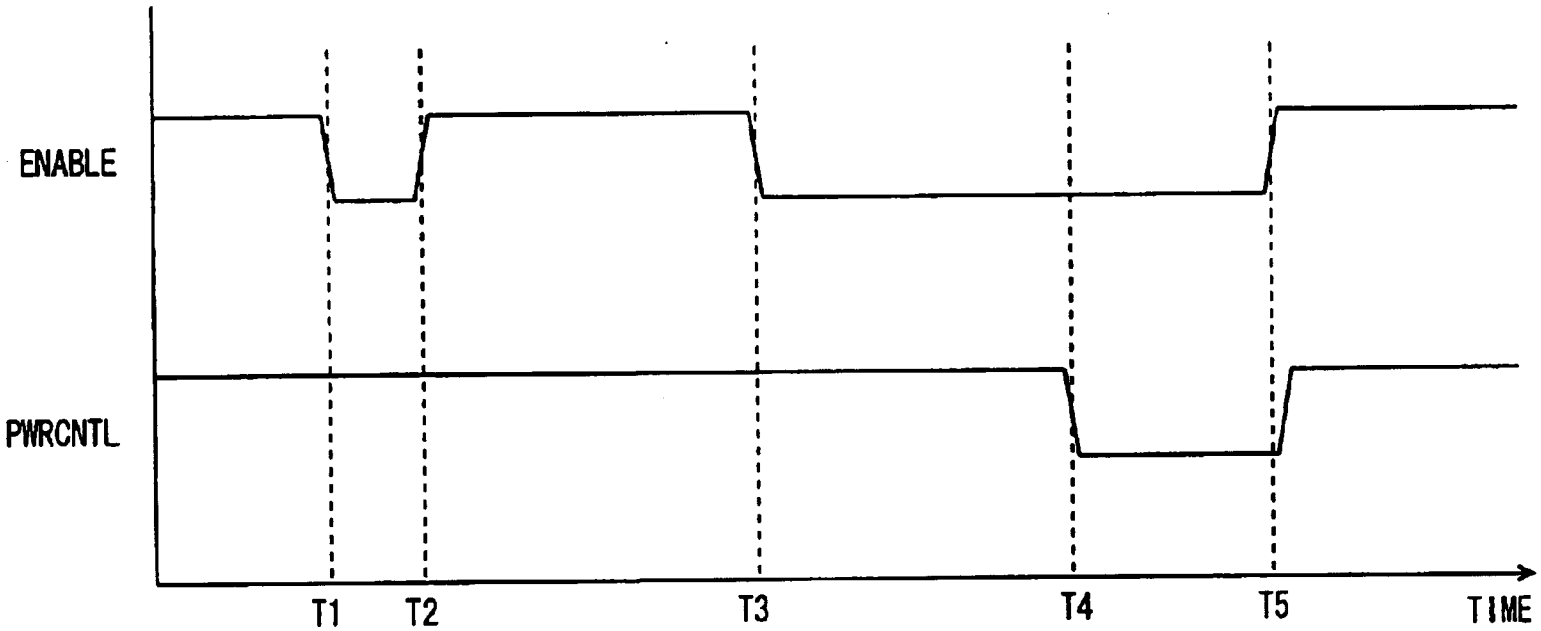
FIG. 3 is an operational waveform diagram illustrating an operation of the time-counting circuit shown in FIG. 1.

FIG. 3 is an operational waveform diagram illustrating the operation of time-counting circuit 28.

Referring to FIG. 3, the vertical axis represents the logic level of each signal, and the horizontal axis represents time. A time period before time T1 represents a normal operation mode, in which signal ENABLE is at H level. Accordingly, P-channel MOS transistor P1 and N-channel MOS transistors N2, N3 have turned on, and N-channel MOS transistors N1, N4 and P-channel MOS transistors P2, P3 have turned off. Therefore, the logic level of the signal of node ND2 is L level, and power control signal PWRCNTL is at H level. Capacitive element C1 is charged by P-channel MOS transistor P1.

At time T1, when signal ENABLE changes from H level to L level, P-channel MOS transistor P3 turns on, N-channel MOS transistor N3 turns off, and the signal of node ND2 is freed from a level fixed to low. Here, P-channel MOS transistor P2 still remains off immediately after signal ENABLE attains L level, even if P-channel MOS transistor P3 turns on. Therefore, the signal of node ND2 does not immediately attain H level.

In addition, when signal ENABLE attains L level, N-channel MOS transistor N1 turns on, electric charges are discharged from capacitive element C1 through resistance element R1 and N-channel MOS transistor N1, and time count starts. At time T2, however, when signal ENABLE returns to H level before the voltage level of node ND1 is lowered to such an extent that P-channel MOS transistor P2 turns on and N-channel MOS transistor N2 turns off, N-channel MOS transistor N3 again turns on, and the signal of node ND2 is again fixed to L level. Therefore, power control signal will not attain L level, and instead maintains H level. Semiconductor device 10 does not make a transition to the low-power operation mode.

At time T2, when signal ENABLE returns to H level, P-channel MOS transistor P1 turns on, and N-channel MOS transistor N1 turns off. Therefore, capacitive element C1 is again charged by P-channel MOS transistor P1.

Next, at time T3, when signal ENABLE again changes from H level to L level, a state immediately after time T1 as described above reappears. That is, electric charges are discharged from capacitive element C1, and time count starts. Then, discharge from capacitive element C1 continues while signal ENABLE maintains L level. At time T4, when the voltage level of node ND1 is sufficiently lowered, P-channel MOS transistor P2 turns on, and N-channel MOS transistor N2 turns off.

Then, P-channel MOS transistors P3, P2 both turn on, the signal of node ND2 attains H level, and power control signal PWRCNTL changes from H level to L level. Therefore, semiconductor device 10 makes a transition to the low-power operation mode. Here, when the signal of node ND2 attains H level, N-channel MOS transistor N4 turns on, and the voltage level of node ND1 is fixed to a ground level. Therefore, the logic level of the signal of node ND2 is latched to H level, and power control signal PWRCNTL is also latched to L level.

Thereafter, at time T5, when signal ENABLE changes from L level to H level, P-channel MOS transistor P3 turns off and N-channel MOS transistor N3 turns on. Therefore, the signal of node ND2 is immediately fixed to L level, and accordingly, power control signal PWRCNTL immediately attains H level. Thus, semiconductor device 10 returns from the low-power operation mode to the normal operation mode.

As described above, time-counting circuit 28 achieves a time-count function with CR-type time constant circuit 54, without including a multi-stage logic gate of large capacity as a conventional time-counting circuit 280. Therefore, power consumption is considerably smaller than in conventional time-counting circuit 280.

In addition, time-counting circuit 28 has a very simple circuit configuration without including the multi-stage logic gate of large capacity, and has circuit area far smaller than conventional time-counting circuit 280.

As described above, according to semiconductor device 10 in the first embodiment, a time-counting circuit indispensable in a semiconductor device capable of transition to a low-power operation mode has been implemented by CR-type time constant circuit 54 and complementary NOR gate 52. Therefore, power consumption in the time-counting circuit can significantly be reduced, and accordingly, power consumption in semiconductor device 10 can be reduced.

Moreover, the circuit area of the time-counting circuit in semiconductor device 10 in the first embodiment is significantly reduced, and the reduction can contribute to reduction of the size of semiconductor device 10.

(Second Embodiment)

A semiconductor device 10A in a second embodiment includes a time-counting circuit 28A instead of time-counting circuit 28 in the configuration of semiconductor device 10 in the first embodiment. Since other circuit configuration in semiconductor device 10A is the same as that in semiconductor device 10, description thereof will not be repeated.

Figure 4:
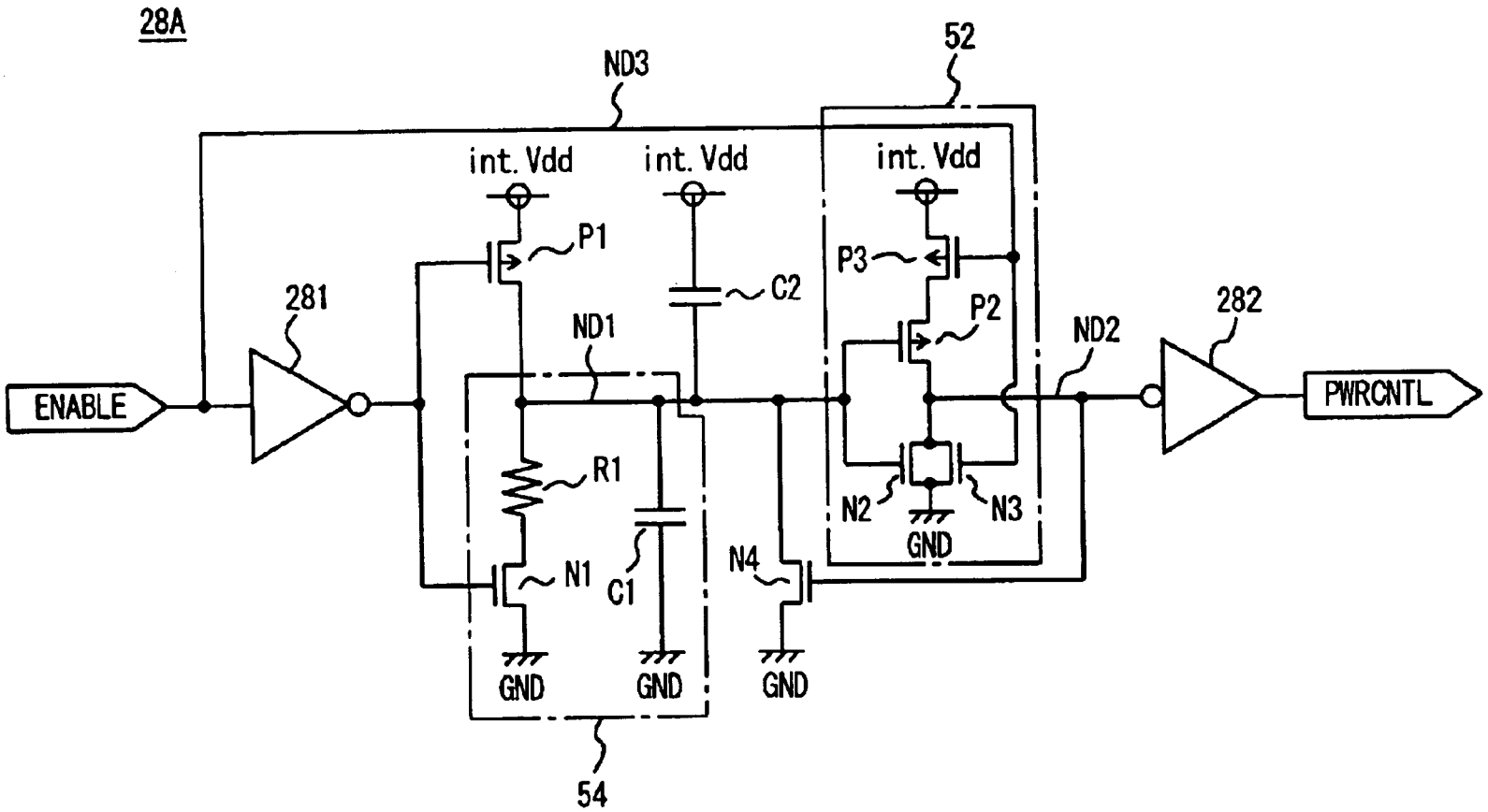
FIG. 4 is a circuit diagram showing a configuration of a time-counting circuit in a semiconductor device according to a second embodiment.

FIG. 4 is a circuit diagram showing a configuration of time-counting circuit 28A in semiconductor device 10A according to the second embodiment.

Referring to FIG. 4, time-counting circuit 28A further includes a capacitive element C2 in the configuration of time-counting circuit 28 in the first embodiment. Capacitive element C2 is connected to internal power supply node int.Vdd and node ND1. Since other configuration in time-counting circuit 28A is the same as that in time-counting circuit 28 in the first embodiment, description thereof will not repeated.

Time-counting circuit 28A in the second embodiment basically operates in a manner similar to time-counting circuit 28 in the first embodiment. Provided with capacitive element C2, however, time-counting circuit 28A will be less susceptible to noise fluctuation of the internal power supply voltage supplied from internal power supply node int.Vdd.

In other words, in time-counting circuit 28 of the first embodiment, when signal ENABLE attains L level and electric charges are discharged from capacitive element C1 through resistance element R1 and N-channel MOS transistor N1, the voltage level of node ND1 will exponentially be lowered at a speed determined by the size of capacitive element C1 and resistance element R1. When the internal power supply voltage supplied from internal power supply node int.Vdd is subjected to noise fluctuation, however, a logic threshold value may fluctuate in P-channel MOS transistor P2, and time until power control signal PWRCNTL is changed to L level may be varied.

On the other hand, in time-counting circuit 28A in the second embodiment, capacitive element C2 is connected to node ND1, and another end thereof is connected to internal power supply node int.Vdd. Then, when power supply fluctuation occurs during discharge of electric charges from capacitive element C1, node ND1 which is an input node of NOR gate 52 will also be subjected to the same power supply fluctuation, which is canceled in P-channel MOS transistor P2. That is, the logic threshold value of P-channel MOS transistor P2 will not be influenced by the power supply fluctuation.

Therefore, in time-counting circuit 28A according to the second embodiment, even if noise fluctuation occurs to the supply voltage, power control signal PWRCNTL can be varied at a desired time count.

As described above, according to semiconductor device 10A in the second embodiment, in a time-counting circuit indispensable in a semiconductor device capable of transition to the low-power operation mode, capacitive element C2 for canceling noise fluctuation of the supply voltage has been provided in addition to components in time-counting circuit 28 of the first embodiment. Therefore, even if the supply voltage may fluctuate, it is possible to count a desired time.

(Third Embodiment)

A semiconductor device 10B in a third embodiment includes a time-counting circuit 28B instead of time-counting circuit 28 in the configuration of semiconductor device 10 according to the first embodiment. Since other circuit configuration in semiconductor device 10B is the same as that in semiconductor device 10, description thereof will not be repeated.

Figure 5:
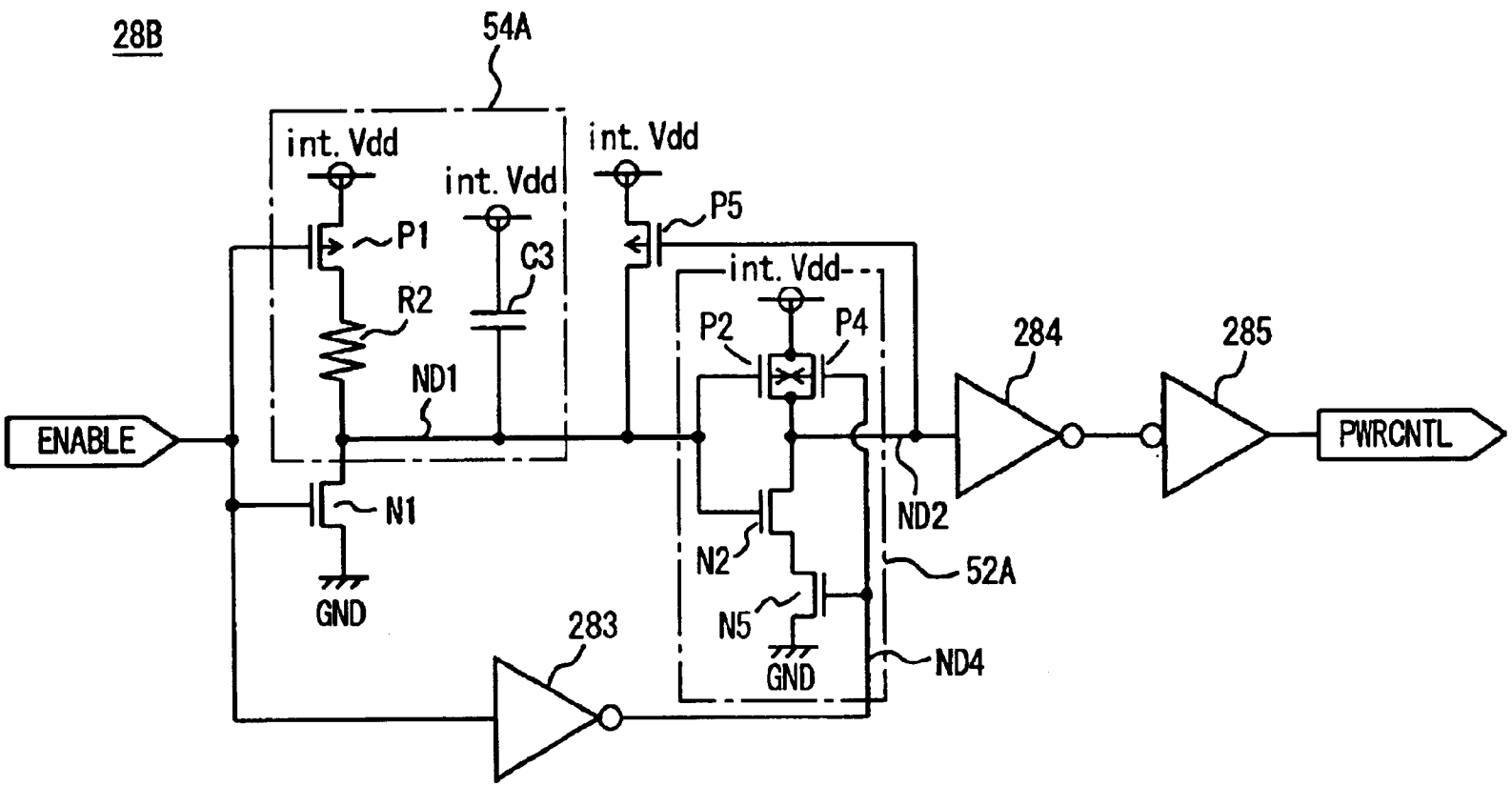
FIG. 5 is a circuit diagram showing a configuration of a time-counting circuit in a semiconductor device according to a third embodiment.

FIG. 5 is a circuit diagram showing a configuration of time-counting circuit 28B in semiconductor device 10B according to the third embodiment.

Referring to FIG. 5, time-counting circuit 28B includes a capacitive element C3, a resistance element R2, P-channel MOS transistors P1, P2, P4, P5, N-channel MOS transistors N1, N2, N5, inverters 283 to 285, and nodes ND1, ND2, ND4. Capacitive element C3 and resistance element R2 constitute a CR-type time constant circuit 52A. In addition, P-channel MOS transistors P2, P4 and N-channel MOS transistors N2, N5 constitute a complementary NOR gate 54A.

P-channel MOS transistor P1 is connected to internal power supply node int.Vdd and resistance element R2, and receives signal ENABLE at the gate. N-channel MOS transistor N1 is connected to node ND1 and ground node GND, and receives signal ENABLE at the gate.

Capacitive element C3 is connected to internal power supply node int.Vdd and node ND1. Resistance R2 is connected to P-channel MOS transistor P1 and node ND1. Here, resistance element R2 may be connected between internal power supply node int.Vdd and P-channel MOS transistor P1.

P-channel MOS transistor P2 is connected to internal power supply node int.Vdd and node ND2, and has the gate connected to node ND1. P-channel MOS transistor P4 is connected to internal power supply node int.Vdd and node ND2, and has the gate connected to node ND4. N-channel MOS transistor N2 is connected to node ND2 and N-channel MOS transistor N5, and has the gate connected to node ND1. N-channel MOS transistor N5 is connected to N-channel MOS transistor N2 and ground node GND, and has the gate connected to node ND4.

Inverter 283 receives signal ENABLE output from clock buffer 22, and outputs a signal obtained by inverting the logic level of signal ENABLE to node ND4. Inverter 284 has an input node connected to node ND2, and outputs a signal obtained by inverting the logic level of the signal of node ND2. Inverter 285 outputs as power control signal PWRCNTL, a signal obtained by further inverting the output signal of inverter 284.

N-channel MOS transistor N1 turns on when signal ENABLE is at H level, and discharges electric charges from capacitive element C3. P-channel MOS transistor P1 turns on when signal ENABLE is at L level, and charges electric charges to capacitive element C3 through resistance element R2.

Capacitive element C3 and resistance element R2 constitute CR-type time constant circuit 54A as described above. When P-channel MOS transistor P1 turns on, capacitive element C3 is charged in accordance with a time constant determined by capacitive element C3 and resistance element R2.

Meanwhile, P-channel MOS transistors P2, P4 and N-channel MOS transistors N2, N5 constitute complementary NOR gate 52A as described above. When signals of nodes ND4 and ND1, which are input nodes, both attain logic H level, NOR gate 52A outputs a signal of L level to node ND2, which is an output node, and accordingly, power control signal PWRCNTL attains L level.

P-channel MOS transistor PS turns on when the logic level of the signal of node ND2 attains L level, and latches node ND2 to L level, along with P-channel MOS transistor P2 and N-channel MOS transistor N2 included in NOR gate 52A.

In the following, an operation of time-counting circuit 28B will be described.

Referring again to FIG. 3, a time period before time T1 represents the normal operation mode, in which signal ENABLE is at H level. Accordingly, N-channel MOS transistor N1 and P-channel MOS transistors P2, P4 have turned on, and P-channel MOS transistor P1 and N-channel MOS transistors N2, N5 have turned off. Therefore, the logic level of the signal of node ND2 is H level, and power control signal PWRCNTL is at H level. Electric charges are discharged from capacitive element C3 by N-channel MOS transistor N1.

At time T1, when signal ENABLE changes from H level to L level, P-channel MOS transistor P4 turns off, N-channel MOS transistor N5 turns on, and the signal of node ND2 is freed from a level fixed to high. Here, N-channel MOS transistor N2 still remains off immediately after signal ENABLE attains L level, even if N-channel MOS transistor N5 turns on. Therefore, the signal on node ND2 does not immediately attain L level.

In addition, when signal ENABLE attains L level, P-channel MOS transistor P1 turns on, capacitive element C3 is charged from internal power supply node int.Vdd through P-channel MOS transistor P1 and resistance element R2, and time count starts. At time T2, however, when signal ENABLE returns to H level before the voltage level of node ND1 is raised to such an extent that P-channel MOS transistor P2 turns off and N-channel MOS transistor N2 turns on, P-channel MOS transistor P4 again turns on, and the signal of node ND2 is again fixed to H level. Therefore, power control signal PWRCNTL will not attain L level, and instead maintains H level. Semiconductor device 10B does not make a transition to the low-power operation mode.

At time T2, when signal ENABLE returns to H level, P-channel MOS transistor P1 turns off, and N-channel MOS transistor N1 turns on. Therefore, electric charges stored in capacitive element C3 is discharged through N-channel MOS transistor N1.

Next, at time T3, when signal ENABLE again changes from H level to L level, a state immediately after time T1 as described above reappears. That is, electric charges are charged to capacitive element C3, and time count starts. Then, charging to capacitive element C3 continues while signal ENABLE maintains L level. At time T4, when the voltage level of node ND1 is sufficiently raised, P-channel MOS transistor P2 turns off and N-channel MOS transistor N2 turns on.

Then, N-channel MOS transistors N2, N5 both turn on, the signal of node ND2 attains L level, and power control signal PWRCNTL changes from H level to L level. Therefore, semiconductor device 10B makes a transition to the low-power operation mode. Here, when the signal of node ND2 attains L level, P-channel MOS transistor P5 turns on, and the voltage level of node ND1 is fixed to a power supply level. Therefore, the logic level of the signal of node ND2 is latched to L level, and power control signal PWRCNTL is also latched to L level.

Thereafter, at time T5, when signal ENABLE changes from L level to H level, P-channel MOS transistor P4 turns on and N-channel MOS transistor N5 turns off. Therefore, the signal of node ND2 is immediately fixed to H level, and accordingly, power control signal PWRCNTL also attains H level immediately. Thus, semiconductor device 10B returns from the low-power operation mode to the normal operation mode.

As in time-counting circuit 28 in the first embodiment, time-counting circuit 28B also achieves its function with CR-type time constant circuit 54A, without including a multi-stage logic gate of large capacity as conventional time-counting circuit 280. Therefore, power consumption is considerably smaller than in conventional time-counting circuit 280.

In addition, time-counting circuit 28B also has a very simple circuit configuration without including a multi-stage logic gate of large capacity. Therefore, circuit area is far smaller than in conventional time-counting circuit 280.

As described above, according to semiconductor device 10B in the third embodiment as well, a time-counting circuit indispensable in a semiconductor device capable of transition to the low-power operation mode can be implemented by CR-type time constant circuit 54A and complementary NOR gate 52A. Therefore, power consumption in the time-counting circuit can significantly be reduced, and accordingly, power consumption in semiconductor device 10B can be reduced.

Moreover, the circuit area of the time-counting circuit in semiconductor device 10B in the third embodiment is also significantly reduced, and the reduction can contribute to reduction of the size of semiconductor device 10B.

(Fourth Embodiment)

A semiconductor device 10C in a fourth embodiment includes a time-counting circuit 28C instead of time-counting circuit 28 in the configuration of semiconductor device 10 in the first embodiment. Since other circuit configuration in semiconductor device 10C is the same as that in semiconductor device 10, description thereof will not be repeated.

Figure 6:
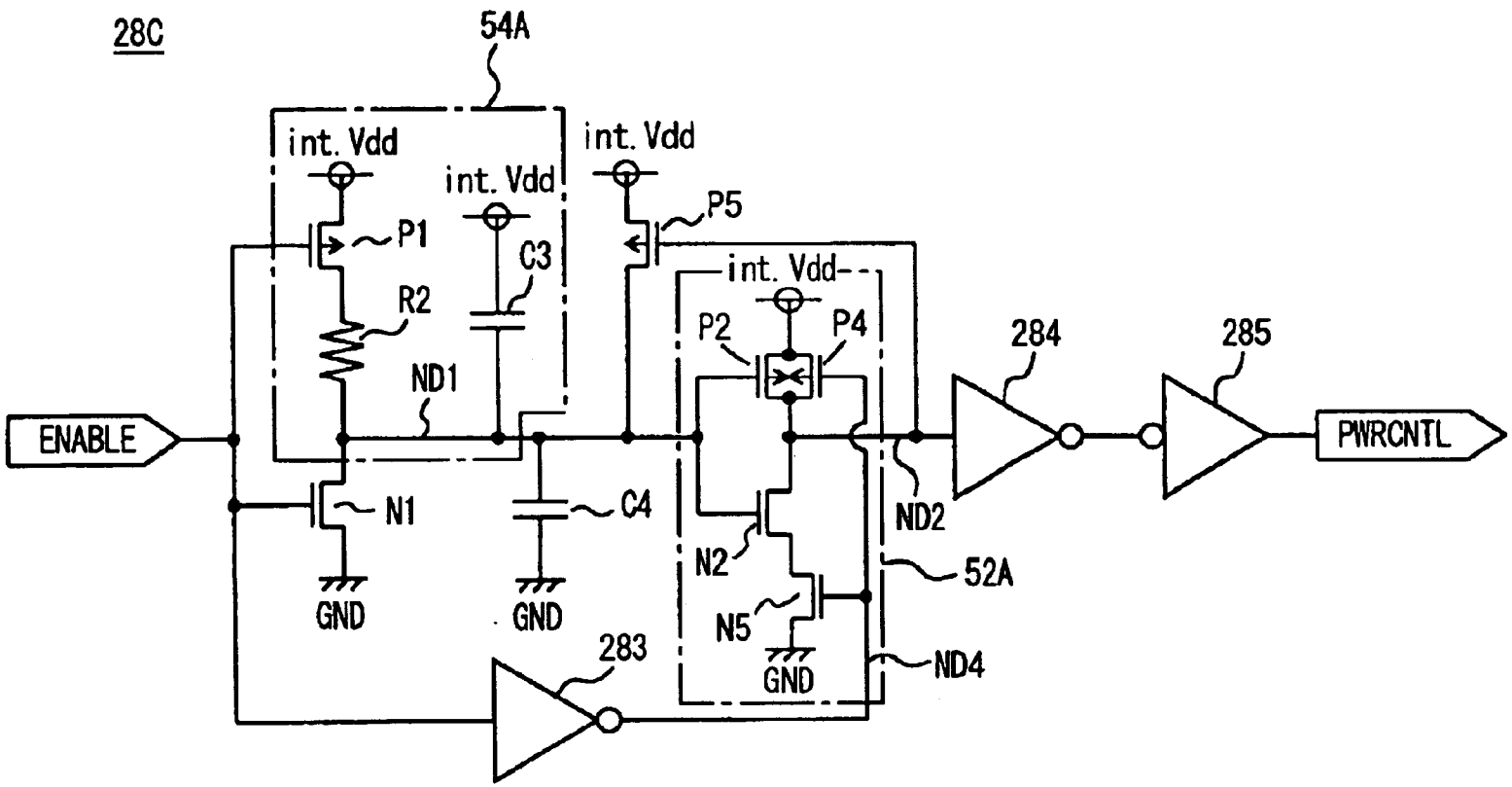
FIG. 6 is a circuit diagram showing a configuration of a time-counting circuit in a semiconductor device according to a fourth embodiment.
Figure 7:
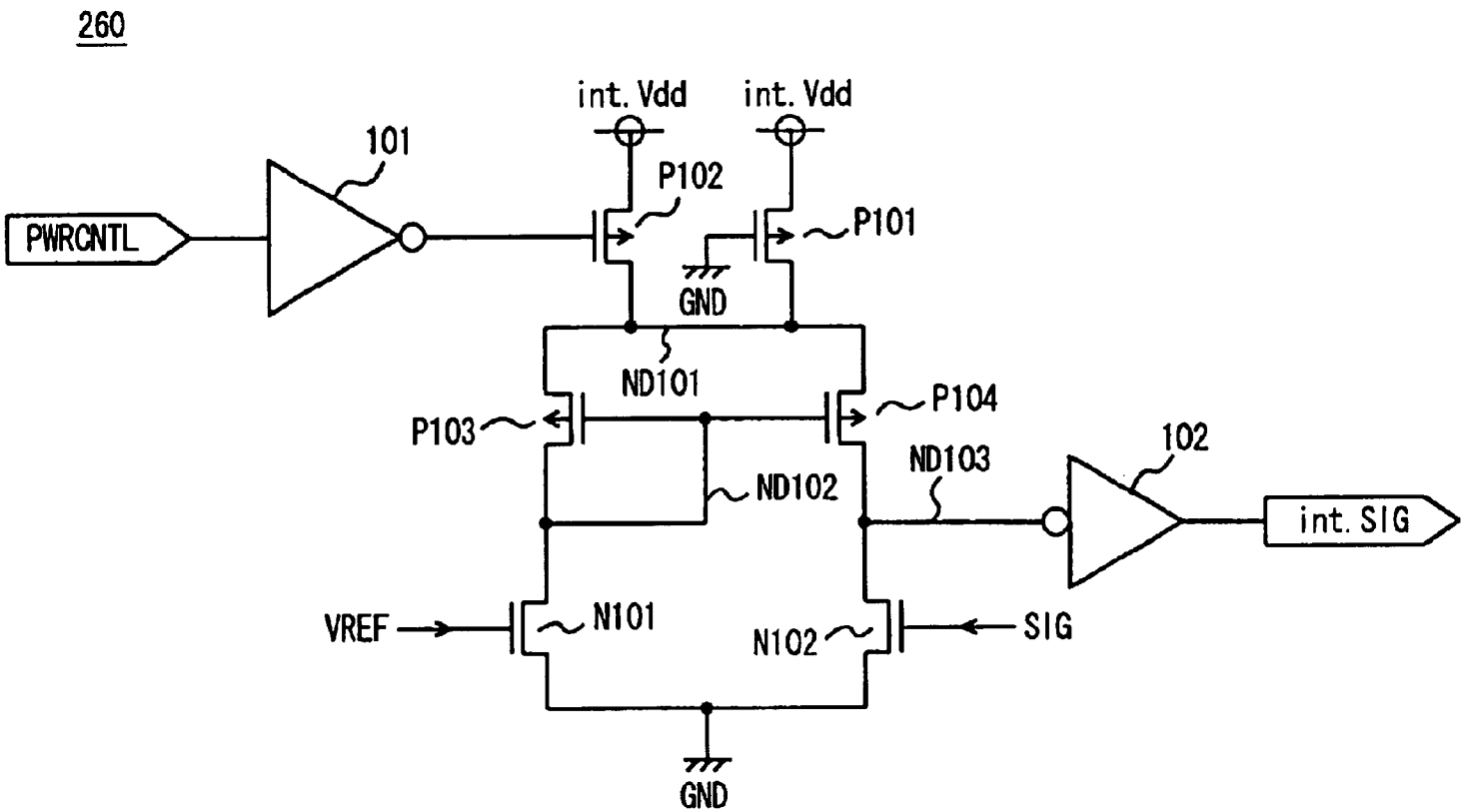
FIG. 7 PRIOR ART
FIG. 7 is a circuit diagram showing a configuration of an input circuit in a conventional semiconductor device.
Figure 8:
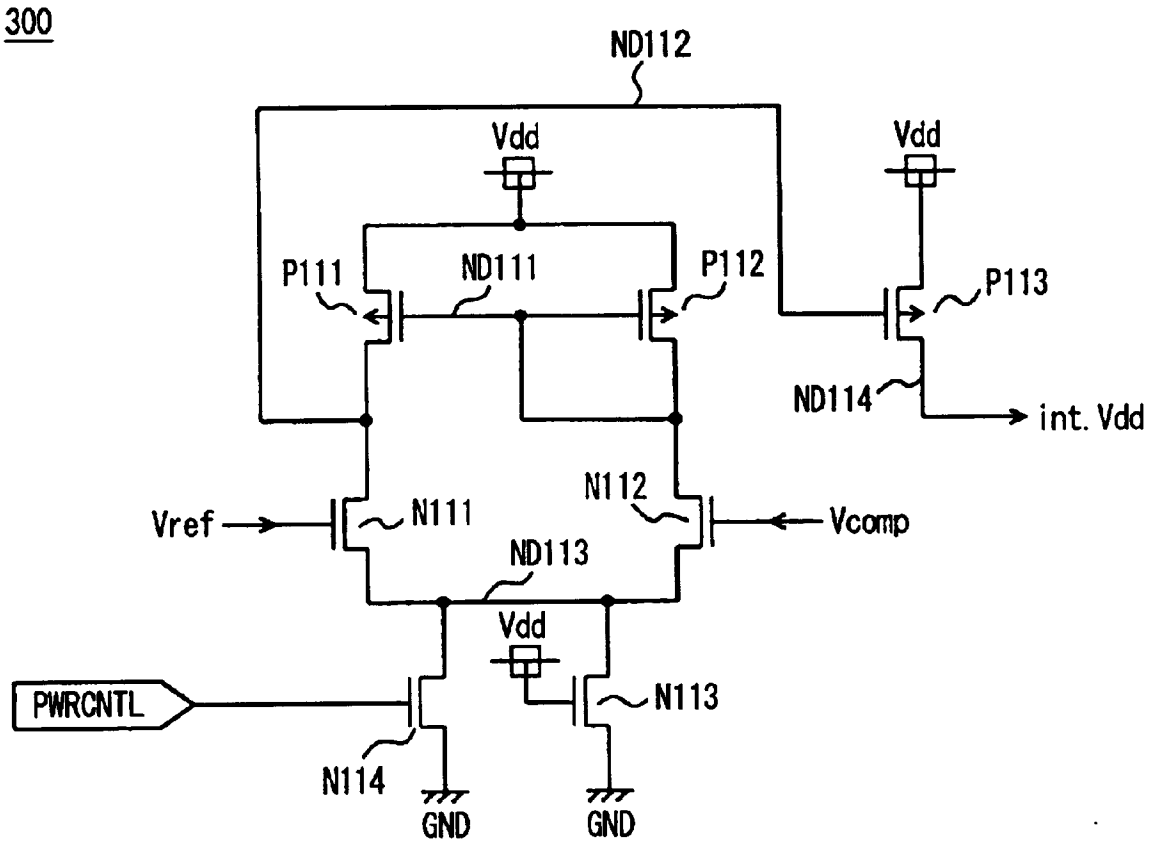
FIG. 8 PRIOR ART
FIG. 8 is a circuit diagram showing a configuration of an internal power generating circuit supplying power to the input circuit shown in FIG. 7.
Figure 9:
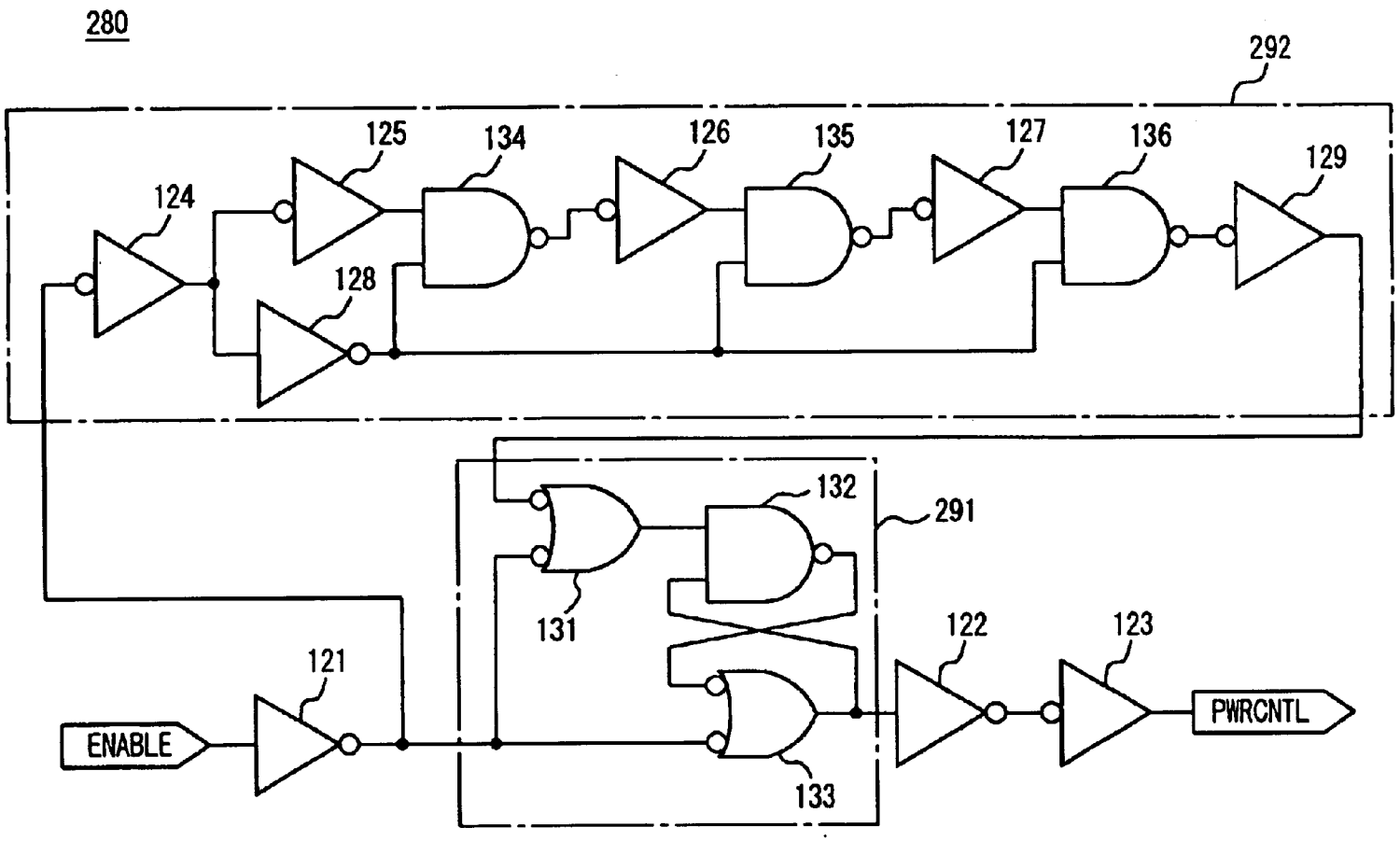
FIG. 9 PRIOR ART
FIG. 9 is a circuit diagram showing a configuration of a time-counting circuit in the conventional semiconductor device.
Figure 10:
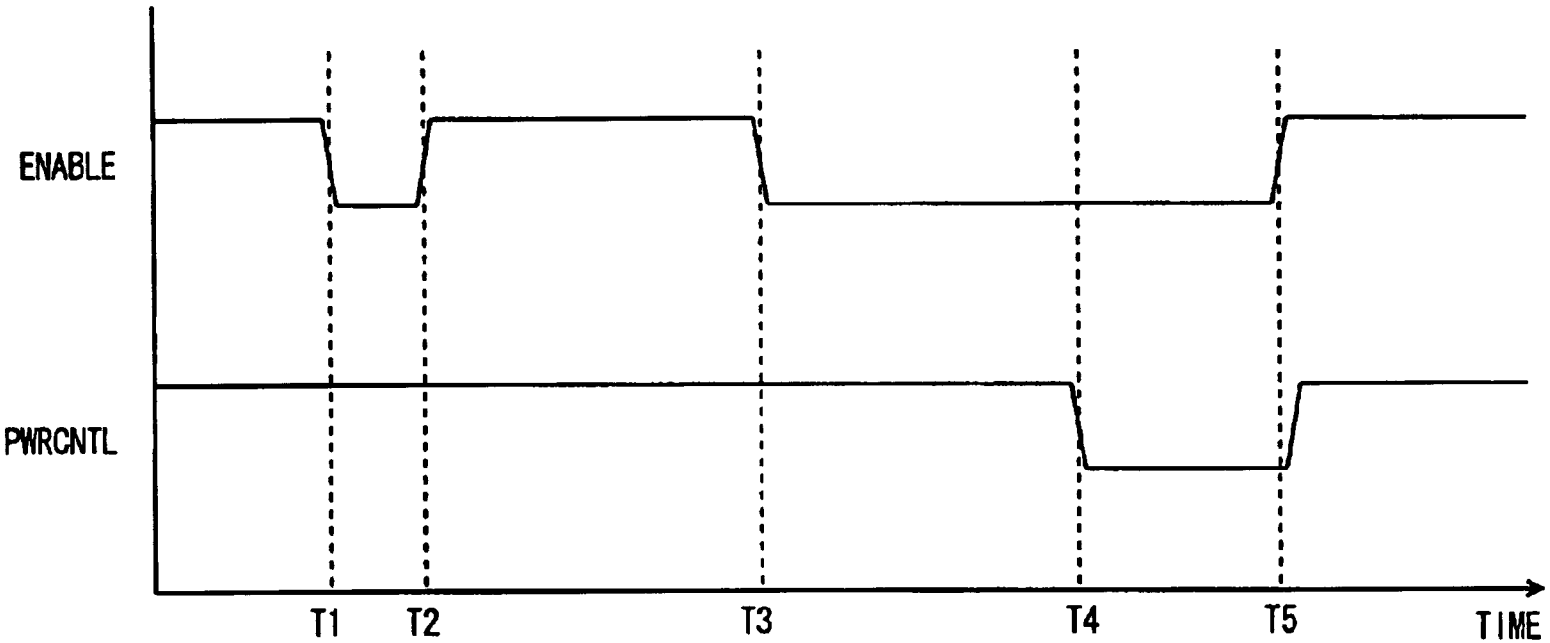
FIG. 10 PRIOR ART
FIG. 10 is an operational waveform diagram illustrating an operation of the time-counting circuit shown in FIG. 9.

FIG. 6 is a circuit diagram showing a configuration of time-counting circuit 28C in semiconductor device 10C according to the fourth embodiment.

Referring to FIG. 6, time-counting circuit 28C further includes a capacitive element C4 in the configuration of time-counting circuit 28B in the third embodiment. Capacitive element C4 is connected to node ND1 and ground node GND. Since other circuit configuration in time-counting circuit 28C is the same as that in time-counting circuit 28B in the third embodiment, description thereof will not be repeated.

Though time-counting circuit 28C in the fourth embodiment basically operates in a manner similar to time-counting circuit 28B in the third embodiment, it will be less susceptible to noise received from ground node GND, because it includes capacitive element C4.

In other words, in time-counting circuit 28B in the third embodiment, when signal ENABLE attains L level and capacitive element C3 is charged through P-channel MOS transistor P1 and resistance element R2, the voltage level of node ND1 will exponentially be raised at a speed determined by the size of capacitive element C1 and resistance element R1. When the ground voltage at ground node GND is subjected to noise fluctuation, however, a logic threshold value may fluctuate in N-channel MOS transistor N2, and time until power control signal PWRCNTL is changed to L level may be varied.

On the other hand, in time-counting circuit 28C in the fourth embodiment, capacitive element C4 is connected to node ND1, and another end thereof is connected to ground node GND. Then, when the ground voltage fluctuates during charging of electric charges to capacitive element C3, node ND1 which is an input node of NOR gate 52A will also be subjected to the same voltage fluctuation, which is canceled in N-channel MOS transistor N2. That is, the logic threshold value in N-channel MOS transistor N2 will not be influenced by fluctuation of the ground voltage.

Therefore, in time-counting circuit 28C according to the fourth embodiment, even if noise fluctuation occurs to the ground voltage, power control signal PWRCNTL can be varied at a desired time count.

As described above, according to semiconductor device 10C in the fourth embodiment, in a time-counting circuit indispensable in a semiconductor device capable of transition to the low-power operation mode, capacitive element C4 for canceling noise fluctuation of the ground voltage has been provided in addition to components in time-counting circuit 28B of the third embodiment. Therefore, even if the ground voltage may fluctuate, it is possible to count a desired time.

In the above-described embodiments, though a semiconductor memory device has been described as an example of a semiconductor device, the scope of the present invention is not limited to the semiconductor memory device. Semiconductor devices with a low-power operation mode, including a time-counting circuit required in transition to that mode would be applicable.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A semiconductor device capable of transition to a low-power operation mode in which the semiconductor device operates on a power lower than a power in a normal operation, comprising:

a time-counting circuit for activating a control signal for transition to said low-power operation mode when a prescribed signal input to the semiconductor device is activated for a prescribed time period; and an internal circuit for reducing power consumption in response to said control signal; wherein said time-counting circuit includes a CR-type time constant circuit including a capacitive element and a resistance element, in which electric charges are charged and discharged to/from said capacitive element in accordance with a time constant determined by a capacitance value of said capacitive element and a resistance value of said resistance element;

a signal output circuit for activating said control signal based on a voltage level determined by a charge state of said capacitive element; and another capacitive element, connected to an input node of said signal output circuit, for canceling noise fluctuation of a power supply voltage or a around voltage, wherein said prescribed time period is determined by said time constant of said CR-type time constant circuit.

2. The semiconductor device according to claim 1, wherein said internal circuit includes a differential amplifying circuit, and said differential amplifying circuit reduces a direct current in response to said control signal.

3. The semiconductor device according to claim 1, wherein said time-counting circuit further includes a charge/discharge control circuit charging and discharging the electric charges to/from said capacitive element, and said charge/discharge control circuit charges the electric charges to said capacitive element when said prescribed signal is at a first logic level, and discharges the electric charges from said capacitive element when said prescribed signal is at a second logic level.

4. The semiconductor device according to claim 3, wherein said capacitive element is connected between a ground node and said input node, said resistance element is connected between said input node and said ground node, said another capacitive element is connected between said input node and a lower supply node, said charge/discharge control circuit includes a first transistor connected between a power supply node and said input node, and a second transistor connected in series with said resistance element between said input node and said ground node, said first transistor is activated when said prescribed signal is at said first logic level, and said second transistor is activated when said prescribed signal is at said second logic level.

5. The semiconductor device according to claim 4, wherein said signal output circuit activates said control signal when the voltage level of said input node is lower than a prescribed threshold value.

6. The semiconductor device according to claim 1, wherein said time-counting circuit further includes a charge/discharge control circuit charging and discharging the electric charges to/from said capacitive element, and said charge/discharge control circuit discharges the electric charges from said capacitive element when said prescribed signal is at a first logic level, and charges the electric charges to said capacitive element when said prescribed signal is at a second logic level.

7. The semiconductor device according to claim 6, wherein said capacitive element is connected between a power supply node and said input node, said resistance element is connected between said power supply node and said input node, said another capacitive element is connected between said input node and a around node, said charge/discharge control circuit includes a first transistor connected in series with said resistance element between said power supply node and said input node, and a second transistor connected between said input node and a ground node, said first transistor is activated when said prescribed signal is at said second logic level, and said second transistor is activated when said prescribed signal is at said first logic level.

* * * * *